US005462125A

United States Patent [19]

Stratton et al.

[11] Patent Number: 5,462,125

[45] Date of Patent: Oct. 31, 1995

[54] AUTOMATIC TIP ANGLE CONTROL

[75] Inventors: Ken L. Stratton, Dunlap; Kevin J. Lueschow, Edwards; James C. Barton, Peoria; Thomas G. Hayes, Ipava, all of Ill.

[73] Assignee: Caterpillar Inc., Peoria, Ill.

[21] Appl. No.: 125,439

[22] Filed: Sep. 22, 1993

[51] Int. Cl.[6] ..... E02F 3/76; G06F 15/50

[52] U.S. Cl. ..... 172/826; 172/2; 364/424.07

[58] Field of Search ..... 172/2, 4, 826; 364/424.07

[56] References Cited

U.S. PATENT DOCUMENTS

| | | | |
|---|---|---|---|
| 3,991,832 | 11/1976 | Cooper | 91/178 X |
| 4,013,875 | 3/1977 | McGlynn | 244/3.15 X |
| 4,424,871 | 1/1984 | Stickney | 172/821 |
| 4,499,541 | 2/1985 | Yuki et al. | 414/273 X |
| 4,520,443 | 5/1985 | Yuki et al. | 414/273 X |
| 5,208,753 | 5/1993 | Acuff | 364/424.07 |

FOREIGN PATENT DOCUMENTS

| | | | |
|---|---|---|---|
| 92427 | 7/1980 | Japan | 172/2 |
| 103130 | 5/1988 | Japan | 172/2 |
| 770444 | 10/1980 | U.S.S.R. | 172/2 |
| 1239233 | 6/1986 | U.S.S.R. | 172/2 |

*Primary Examiner*—Randolph A. Reese
*Assistant Examiner*—Christopher J. Novosad
*Attorney, Agent, or Firm*—R. Carl Wilbur

[57] ABSTRACT

An off-highway vehicle having an earth moving implement has a tilt function associated with the implement. For example, a bulldozer has a tilt function associated with the bulldozer blade. The vehicle has a processor adapted to receive a position signal from a position sensor associated with the tilt function of the implement. The operator engages a switch to activate an automatic tilt function. A selector switch is provided so that the operator can select between a plurality of pre-set blade angles. The selector switch outputs a target position signal associated with a pre-set angle to the processor. The processor automatically calculates a command signal for the tilt function based on the difference between the position signal and the target position signal. The processor issues the command signal to the tilt function causing the tilt function to move the implement to the pre-set angle associated with the switch position.

18 Claims, 4 Drawing Sheets

AUTOMATIC TIP ANGLE CONTROL

TECHNICAL FIELD OF THE INVENTION

The present invention relates to off-highway vehicles having an earth moving implement. More particularly, the present invention relates to a device and method for automatically moving the vehicle implement to one of several pre-set blade angle positions.

BACKGROUND OF THE INVENTION

Off-highway vehicles such as wheel loaders, bulldozers, and track loaders, for example, have a bucket or other implement to move soil. The drawbacks of such vehicles are described herein with reference to a bulldozer. However, these same drawbacks are also encountered on all other similar off-highway vehicles.

Typically, the operator must move the earthmoving implement (in the case of a bulldozer the earthmoving implement is a blade) to certain angles while performing a specific task. For example, in a typical bulldozing operation there are three modes in which the bulldozer operates. These modes include a loading mode, a spreading mode and a carrying mode. During the load mode the operator cuts or scrapes the ground to loosen soil, during the carry mode the loosened soil is pushed or carried to a different location, and during the spread mode the soil is dumped or spread in the second location. The blade angle (i.e., the angle of the blade relative to the ground) significantly affects bulldozer performance. Each mode has a different optimum blade angle.

Typically, the bulldozer is repeatedly sequenced through each mode. The operator will begin by loading for a short time until enough soil has been scraped from the work area. Then the operator will carry and spread the soil. The operator will then repeat the sequence. To operate the bulldozer most efficiently, the operator must change the blade angle each time he or she changes modes.

Traditional bulldozer blade controls include a tilt control for the operator to change the blade angle and a lift control to change the blade height. Those controls require the operator to manually adjust the blade angle to the optimum blade angle when changing to a new mode. Changing the blade angle in this manner requires concentration and manual dexterity, which may cause operator fatigue and reduce overall productivity.

It would be preferable to have a blade adjustment feature that automatically moved the blade to the optimum angle for a given mode. The present invention is directed toward overcoming one or more of these problems.

SUMMARY OF THE INVENTION

In one aspect of a preferred embodiment of the present invention an off-highway vehicle having a tilt function associated with an implement is provided with an automatic tilt system. The tilt system includes a tilt cylinder and an associated position sensor having a position signal output. Also included is a processor means adapted to receive the position signal and calculate a command signal corresponding to the difference between the position signal and a desired blade angle position.

The foregoing and other aspects of the present invention will become apparent from reading the detailed description of the invention in conjunction with the drawings and appended claims.

DETAILED DESCRIPTION OF THE INVENTION

The following detailed description of the invention will describe one application of the preferred embodiment-use on a bulldozer. However, the present invention is not limited to use on a bulldozer. To the contrary, the present invention encompasses application of a preferred embodiment on other off-highway vehicles having an implement. The following detailed description applies equally to use of the invention in connection with those other vehicles, for example, wheel loaders, track loaders, etc.

Figure 1:
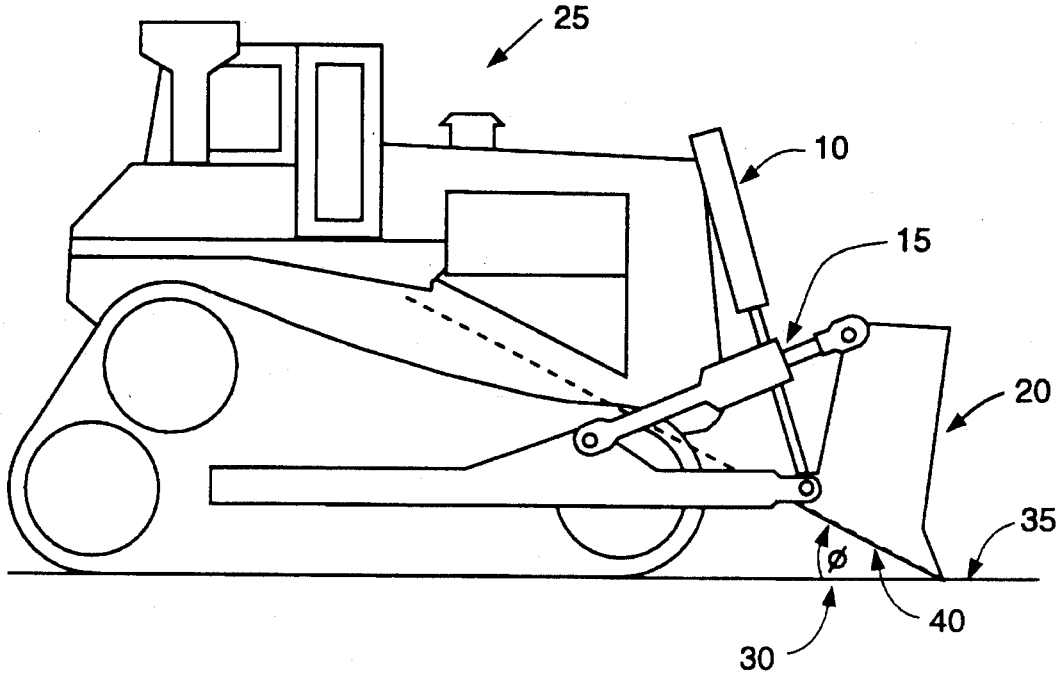
FIG. 1 is a side view of a bulldozer incorporating the automatic tilt control of the present invention.

FIG. 1 shows the general relationship between the lift cylinders 10, the tilt cylinders 15, and the blade 20 to the bulldozer 25. Note that there are actually two lift cylinders 10 and two tilt cylinders 15, one each on opposing sides of the bulldozer. However, only one of each is shown in the drawing.

The blade angle 30 is the angle formed between a plane substantially tangent to the ground 35 and the plane formed by the bottom 40 of the blade 20. The blade angle 30 is a function of the specific geometric relationship of the various components of the bulldozer 25. As shown in FIG. 1, the position of the tilt cylinders 15, in part, determines the blade angle 30. The use of tilt cylinders 15 and lift cylinders 10 to change the blade position is well known in the art and will not be described further.

Figure 2:
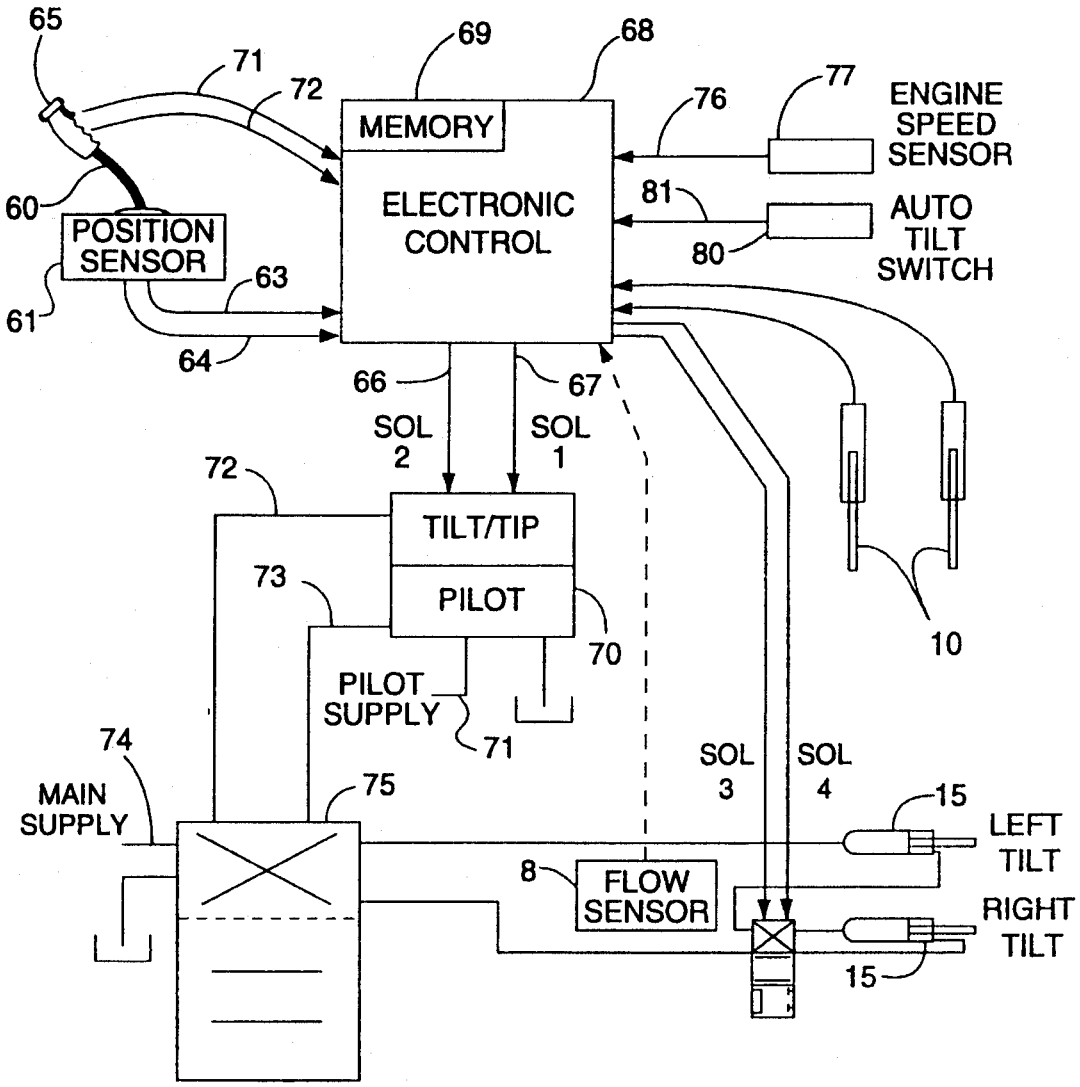
FIG. 2 illustrates, in block diagram form, the automatic tilt control of the present invention.

FIG. 2 shows a block diagram of the control components of the automatic tilt control system of the present invention. As can be seen in the figure, the operator controls the blade by using the handle 60. Included on the handle is a three position switch 65 that allows the operator to select one of the three operational modes: load, carry or spread. The three position switch 65 produces a mode select signal that is an input to the electronic control 68 through connections 71,72. The operator may use the three position switch to automatically move the blade angle position to a pre-set angle associated with a particular mode. Typically, the operator can adjust the blade angle 30 by pulling a trigger 73 located on the handle 60, and moving the handle from a neutral position to one of a plurality of left positions or from the neutral position to one of a plurality of right positions. By pulling the trigger 73 and moving the handle 60 to a left position, the operator decreases the blade angle 30. By pulling the trigger 73 and moving the handle 60 to a right position, the operator increases the blade angle 30. When no force is exerted on the handle 60, it remains in an intermediate neutral position between left and right stops. Although in the preferred embodiment, the blade angle is increased or decreased by a combination of movement of a trigger 73 and a handle 60, other controls are known that could be readily and easily implemented to permit the operator to make such changes. The present invention is not limited to a single set of controls, but to the contrary includes all such controls that fall within the spirit and scope of the invention as defined by the appended claims.

A position sensor 61 is located at the base of the handle 60 to produce fore and aft signals 63, 64 that are proportional to the difference between the actual position of the handle and the position of the handle when it is in the rest position. The fore and aft signals 63, 64 are inputs to the electronic control 68, which in turn produces solenoid driver signals 66, 67 to drive the proportional pilot valve 70. The pilot valve 70 controls the flow of hydraulic fluid from the high pressure pilot supply 71 to the tilt actuator valve 75 through the conduits 72, 73 and thereby controls the position of the tilt actuator valve 75. The tilt actuator valve 75 in turn controls the amount and direction of high pressure fluid flowing from the main supply 74 to the tilt cylinders 15. In this manner, the electronic control 68 controls the fluid flow to the tilt cylinders 15. Thus, by manipulating the handle 60, the operator can control the blade angle 30.

Stored in memory 69 within the electronic control 68 are the geometric relationships between the bulldozer components. Although in the preferred embodiment the memory 69 is included within the electronic control 68 it is known in the art to provide a distinct memory device. The electronic control 68 can then calculate the blade angle 30 from the stored geometric relationships once it determines the positions of the lift cylinders 10 and the tilt cylinders 15.

There are many known devices that can measure an absolute cylinder position. For example, one could use an absolute position sensor such as an Radio Frequency sensor (RF sensor) or an LVDT sensor, both of which are well known in the art. However, these devices are expensive and add to the overall cost of the vehicle. Instead, as described below, in a preferred embodiment of the present invention the electronic control 68 approximates the position of the lift cylinders 10 and the tilt cylinders 15 by measuring the amount of hydraulic fluid that enters the particular cylinders. This sensing system produces a relative position of the tilt cylinder with respect to a previously established position. Thus, using this system, it is first necessary to establish a known position and then calculate subsequent positions by the amount of fluid that was introduced into, or removed from, the cylinder.

In a preferred embodiment of the present invention, the tilt cylinders 15 are "zeroed" by issuing a retract command so that the cylinder is fully retracted against a mechanical stop (not shown in the drawings). The electronic control 68 issues a command to the pilot valve 70 that causes the tilt actuator valve 75 to allow fluid from the main supply 74 to flow into the tilt cylinders 15, causing the tilt cylinders 15 to retract against the mechanical stops. The electronic control 68 then stores data in memory 69 corresponding to that "zeroed" position. Then, subsequent positions are calculated by determining the flow of hydraulic fluid into the cylinder.

The amount of fluid entering the tilt cylinder can be calculated by integrating the flow rate into the cylinder over time. Thus, the electronic control 68 can calculate the tilt_cylinder_position at any time from EQN 1.

EQN. 1 $\text{tilt_cylinder_position}=\text{initial_position}+K\int_o^t \text{flow}\,dt$ where K=1/(cross sectional area of the cylinder) and
t=on time of the hydraulic cylinder The flow in EQN 1 into the tilt cylinders 15 could be calculated by placing a flow meter 8 on the conduits to the tilt cylinders 15. However, it is also possible to approximate the flow rate as a function of engine speed so long as there is only a single demand on the hydraulic system.

In a preferred embodiment of the present invention, the electronic control 68 approximates the flow rate from the engine speed signal 76 of the engine speed sensor 77 and calculates the amount of fluid entering the tilt cylinders 15 as a function of the flow rate (as calculated by the engine speed) and the cylinder on time. Because the hydraulic flow for a given engine speed is known only if there are no other demands on the hydraulic system, it is important that the electronic control 68 only operate the tilt cylinders 15 alone. Substituting engine speed for flow in EQN 1 yields:

EQN. 2 $\text{tilt_cylinder_position}=\text{initial_position}+K1\int_o^t \text{engine speed}\,dt$ where K1=empirically determined constant and
t=on time of the hydraulic cylinder As shown in EQN. 1 and EQN. 2, the tilt_cylinder_position is an integration function. As with any integration function, an integration error may develop over time. Thus, as noted above, it is necessary to periodically "zero" the tilt cylinders 15 by forcing them to known positions and storing that known position in memory.

Referring again to FIG. 2, the operator selects the automatic tilt mode by depressing the automatic tilt mode switch 80, which sends an automatic tilt signal 81 to the electronic control 68. The electronic control 68 will thereafter issue a command to move the tilt cylinders 15 to the pre-set blade angle 30 corresponding to the given position of the thumb switch 65.

Figure 3A:
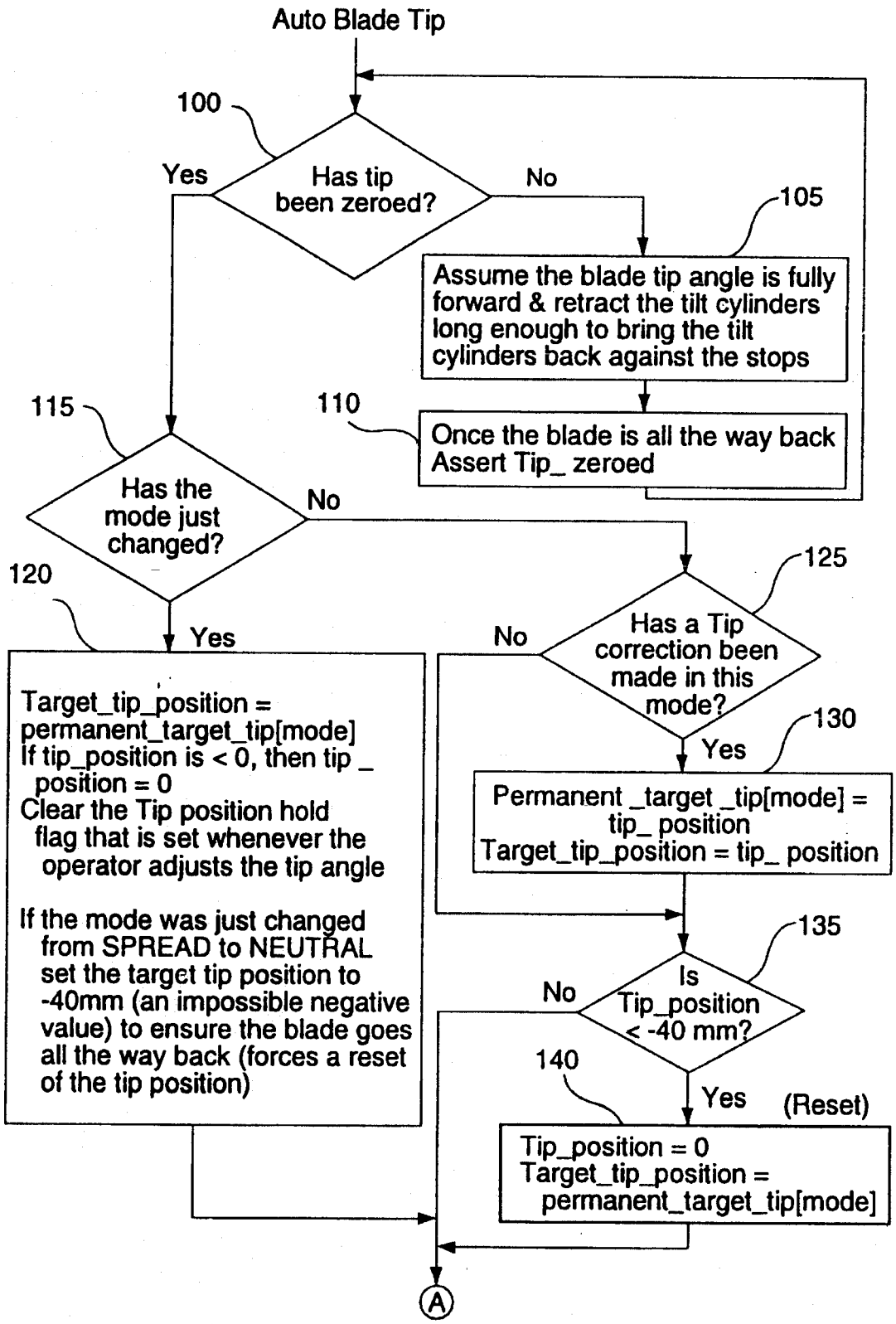
FIG. 3*a* and 3*b* illustrate flow charts of the control strategy implemented in software in the preferred embodiment of the present invention.
Figure 3B:
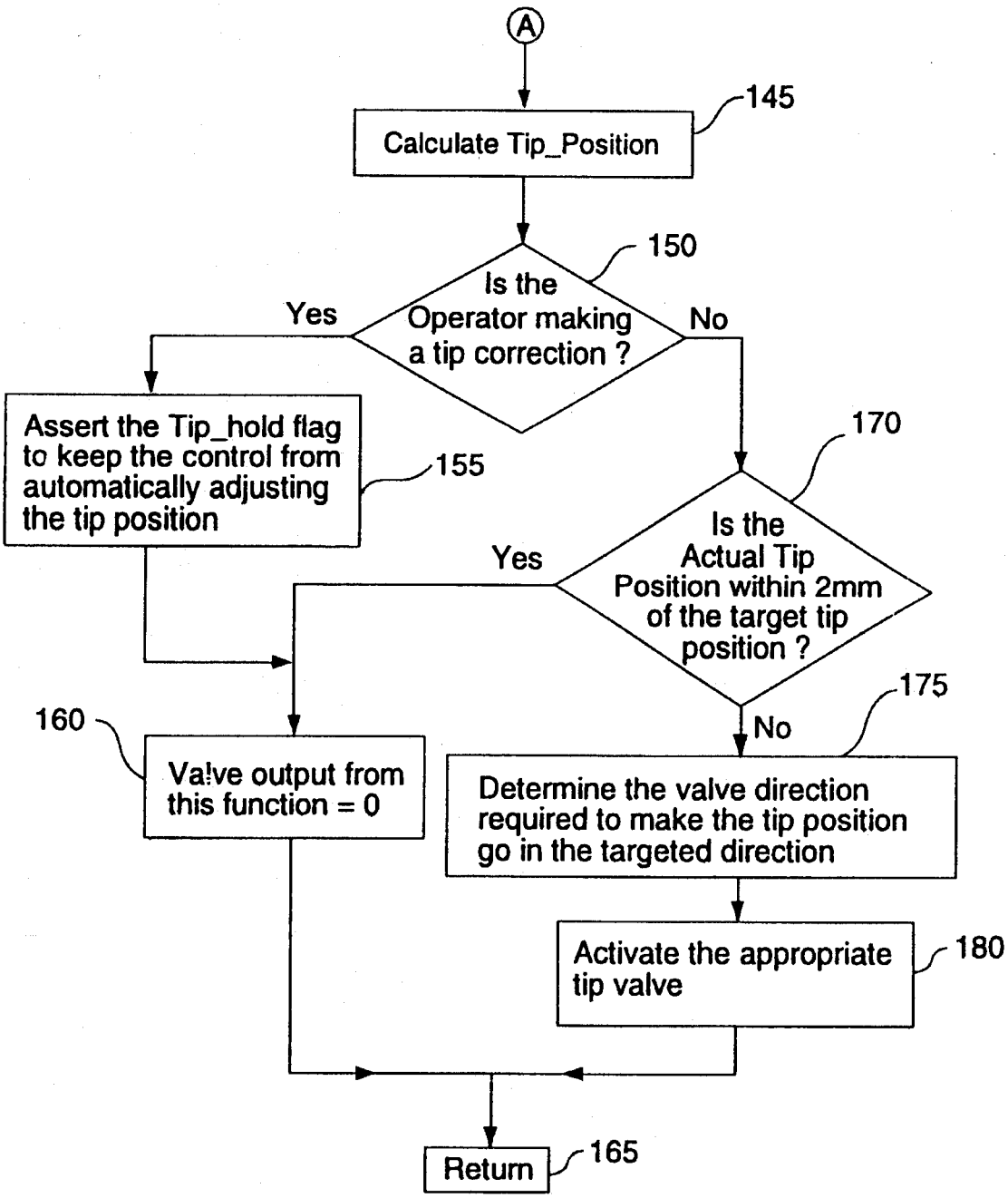

Turning now to FIG. 3*a* and 3*b*, a flow chart illustrating the operation of the automatic tilt system of the present invention is shown. The flowchart represents a full and complete set of the instructions necessary to implement the control strategy of the present invention in software in the electronic control 68 of the present invention. The software may be written from this flowchart for any suitable microprocessor using the instruction set for that microprocessor. Implementing the software control would be a mechanical step for one skilled in the art of writing such software.

Referring first to FIG. 3*a*, the program control of the present invention commences when the operator has engaged the automatic tilt switch 80. Then, in block 100 the automatic tilt system first determines whether the tilt cylinders 15 have been zeroed by checking a tip_zeroed flag. If the tip_zeroed flag is not set, then the system proceeds through blocks 105 and 110 to zero the tilt cylinders 15. In block 105 the electronic control 68 issues a command to the proportional pilot valve 70 that will cause the actuator valve 75 to allow hydraulic fluid to flow to the tilt cylinders 15 to retract the tilt cylinders 15. The electronic control 68 issues the command for a sufficient length of time to insure that the tilt cylinders 70 are fully retracted. In block 110, the electronic control 68 then sets the tip_zeroed flag to indicate that the tilt cylinders have been zeroed. Program control is then returned to block 100.

Once the tilt cylinders 15 have been zeroed and the tip_zeroed flag has been set, then in block 115 the electronic control 68 determines whether the operator has just changed modes by monitoring signals 71, 72 from the three position switch 65. If the operator has just changed modes, then program control passes to block 120 where the target_tip_position is set to the permanent_target_tip for that mode.

The target_tip_position variable represents the commanded tip position. Thus, the electronic control 68 will issue a command to the proportional pilot valve 70 to cause the tilt cylinder to move to the position corresponding to the target_tip_position.

The permanent_target_tip is a value stored in memory 69 corresponding to the position of the blade tip (which in turn is a function of the blade angle) when the operator exited a particular mode. Thus, there is a permanent_target_tip_position for each mode. The label permanent_target_tip_position generically refers to three variables stored in memory 69 in an array: permanent target_tip [load], permanent_target_tip [carry], and permanent_target_tip [spread]. By setting the target_tip_position equal to the permanent_target_tip_position in block 130, the blade angle will return to the same blade angle existing prior to exiting that mode. For example, if the blade angle was 10 degrees when the operator changed from load to carry, when the operator returns to the load mode, the blade will return to a 10 degree angle.

In block 120, the electronic control 68 also sets the current tip_position to zero if, because of an error or some other reason, the current tip_position value is less than zero. The tip_position is a variable that stores the sensed position of the tilt cylinders 15. Also, the tip_position hold flag is cleared and the system determines if the bulldozer is backing up (designated as placing the autotilt system in NEUTRAL) in which case the target tip position is set to –40 mm (an impossible negative value) to "zero" the tilt cylinders, as described above, by forcing then against their mechanical stops. In this manner, the tilt cylinders 15 are zeroed each time the bulldozer backs up.

Returning to block 115, if the operator has not changed modes then control passes to block 125. In block 125 the electronic control 68 determines whether the operator has manually adjusted the tip_position while in the current mode. If the operator has made a manual adjustment, then control passes to block 130 where the system sets the permanent_target_tip of that mode to the then current tip_position; the target_tip_position is also set to the then current tip_position. In this manner, because the permanent_target_tip_position for that mode is set to the last tip_position of the blade for that mode, the blade will return to that position when the operator re-enters that mode. Control then passes to block 135.

if the value of the then current tip_position is less than –40 mm then the electronic control 68 resets the tip_position to zero and resets the target_tip_position to the permanent_target_tip_position for that mode (block 140).

Referring to FIG. 3*b*, the blade angle is then calculated in block 145 according to EQN. 2 given above. Then, in block 150, if the operator is currently making a manual adjustment to the blade angle 30, program control proceeds along the left branch to block 155 where the electronic control 68 sets the tip_hold flag. While the tip_hold flag is set the electronic control 68 will not issue an automatic command to the proportional pilot valve 70 to cause the blade to move to a target position. Control then passes to block 160 where the electronic control 68 issues a tilt cylinder command corresponding to no movement. Finally, control returns to the beginning of the routine (block 100) through block 165.

Referring again to block 150 of FIG. 3*b*, if the operator is not making a blade angle adjustment, then in block 170 the system determines whether the blade tip_position is within an arbitrary tolerance of the target_tip_position; in the preferred embodiment, the tolerance is 2 millimeters. It can be seen, however, that in other applications another tolerance could easily be substituted. If the blade tip_position is within two millimeters of the target_tip_position then the valve output is zero (block 160). If, however, the blade tip_position is not within the two millimeter tolerance then control passes to block 175. The automatic tilt system then calculates the tilt actuator 75 output required to move the blade tip_position to within a tolerance of 2 millimeters from the target_tip_position. In block 180 the electronic control 68 issues a command to the proportional pilot valve that causes the tilt actuator 75 valve to open for the appropriate duration to move the tilt cylinder to the target_tip_position. Then in block 165 control is returned to block 100.

We claim:

1. On an off-highway vehicle having a tilt function associated with an implement, an automatic tilt system comprising:

a tilt actuator;

position sensing means for sensing the position of the tilt actuator and for outputting a position signal corresponding to the sensed position, wherein said position sensing means includes an engine speed sensor;

processor means for receiving the position signal, calculating an implement tilt angle position, calculating a command signal corresponding to the difference between the implement tilt angle and a desired implement angle position, and for outputting the command signal to the tilt actuator; and selector means for selecting one of several pre-set implement tilt angle positions and for outputting a selection signal corresponding to the selected pre-set implement tilt angle position.

2. The automatic tilt system according to claim 1 wherein said selector means includes a three position selector switch.

3. On an off-highway vehicle having a tilt function associated with an implement, an automatic tilt system comprising:

a tilt actuator;

position sensing means for sensing the position of the tilt actuator and for outputting a position signal corresponding to the sensed position, wherein said position sensing means includes an RF sensor;

processor means for receiving the position signal, calculating an implement tilt angle position, calculating a command signal corresponding to the difference between the implement tilt angle and a desired implement angle position, and for outputting the command signal to the tilt actuator; and selector means for selecting one of several pre-set implement tilt angle positions and for outputting a selection signal corresponding to the selected pre-set implement tilt angle position.

4. The automatic tilt system according to claim 3 wherein said selector means includes a three position selector switch.

5. On an off-highway vehicle having tilt function associated with an implement, an automatic tilt system comprising:

a tilt actuator;

position sensing means for sensing the position of the tilt actuator and for outputting a position signal corresponding to the sensed position, wherein said position sensing means includes an LVDT sensor;

processor means for receiving the position signal, calculating an implement tilt angle position, calculating a command signal corresponding to the difference between the implement tilt angle and a desired implement angle position, and for outputting the command signal to the tilt actuator; and selector means for selecting one of several pre-set implement tilt angle positions and for outputting a selection signal corresponding to the selected pre-set implement tilt angle position.

6. The automatic tilt system according to claim 5 wherein said selector means includes a three position selector switch.

7. On an off-highway vehicle having a tilt function associated with an implement, an automatic tilt system comprising:

a tilt actuator;

position sensing means for sensing the .position of the tilt actuator and for outputting a position signal corresponding to the sensed position;

processor means for receiving the position signal, calculating an implement tilt angle position, calculating a command signal corresponding to the difference between the implement tilt angle and a desired implement angle position, and for outputting the command signal to the tilt actuator; and selector means for selecting one of several pre-set implement tilt angle positions and for outputting a selection signal corresponding to the selected pre-set implement tilt angle position, wherein said selector means includes a three position selector switch.

8. On an off-highway vehicle, an automatic tilt system comprising:

an implement;

tilt means for causing a change in the implement tilt angle;

a position sensor associated with said tilt means, said position sensor having a position signal output responsive to the implement tilt angle;

selector means for selecting one of a plurality of pre-set implement tilt angles and outputting a selection signal based on said selection, wherein said selector means includes a thumb switch;

an electronic control adapted to receive said position signal output and said selection signal and produce a command signal responsive to a difference between said implement tilt angle position as determined by said position sensor and the selected pre-set implement tilt angle; and an actuator valve connected to said tilt means, said actuator valve being adapted to receive said command signal.

9. An automatic tilt system according to claim 8, including adjustment means for allowing adjustment of said preselected implement tilt angle positions.

10. On an off-highway vehicle, an automatic tilt system comprising:

an implement;

tilt means for causing a change in the implement tilt angle;

a position sensor associated with said tilt said position sensor having a position signal output responsive to the implement tilt angle, wherein said position sensor includes an engine sensor;

selector means for selecting one of a plurality of pre-set implement tilt angles and outputting a selection signal based on said selection;

an electronic control adapted to receive said position signal output and said selection signal and produce a command signal responsive to a difference between said implement tilt angle position as determined by said position sensor and the selected pre-set implement tilt angle, wherein said electronic control is adapted to receive a signal from said engine sensor and produce an implement tilt angle; and an actuator valve connected to said tilt means, said actuator valve being adapted to receive said command signal.

adjustment means for allowing adjustment of said preselected implement tilt angle positions.

11. The automatic tilt system according to claim 10, wherein said selector means includes a thumb switch.

12. On an off-highway vehicle, an automatic tilt system, comprising:

an implement;.

an implement adjustment handle;

a first position sensor associated with said implement adjustment handle;

a switch associated with said implement adjustment handle;

a tilt actuator connected to said implement;

a second position sensor associated with said tilt actuator;

an electronic control connected to said first position sensor, said switch and said second position sensor, said electronic control responsively producing a command signal;

a supply of pressurized hydraulic fluid;

a tilt actuator valve adapted to receive the command signal from the electronic control and responsively control the flow of pressurized hydraulic fluid flow from said supply to the tilt actuator;

memory means for storing a value corresponding to a pre-set implement tilt angle;

wherein said switch includes a plurality of switch positions, each switch position corresponding to a pre-set implement tilt angle; and wherein the stored value corresponds to an output of said second position sensor immediately before a change in a switch position of said switch.

13. On an off-highway vehicle, an automatic tilt system comprising:

an implement;

an implement adjustment handle;

a first position sensor associated with said implement adjustment handle;

a switch associated with said implement adjustment handle;

a tilt actuator connected to said implement;

a second position sensor associated with said tilt actuator; an electronic control connected to said first position sensor, said switch and said second position sensor, said electronic control responsively producing a command signal;

a supply of pressurized hydraulic fluid;

a tilt actuator valve adapted to receive the command signal from the electronic control and responsively control the flow of pressurized hydraulic fluid flow from said supply to the tilt actuator; and wherein said second position sensor includes an engine speed sensor and said electronic control is adapted to receive a signal from said engine speed sensor and calculate the tilt actuator position from the engine speed signal and the on time of the tilt actuator.

14. An automatic tilt system according to claim 13, including memory means for storing a value corresponding to a pre-set implement tilt angle.

15. An automatic tilt system according to claim 14, wherein said switch includes a plurality of switch positions, each switch position corresponding to a pre-set implement tilt angle.

16. An automatic tilt system according to claim 15, wherein the stored value corresponds to an output of said second position sensor immediately before a change in a switch position of said switch.

17. A method for automatically controlling the tilt angle of an implement on an off-highway vehicle having a selector switch, a tilt actuator, position sensing means for sensing the position of the tilt actuator and outputting a position signal corresponding to the sensed position, and an electronic control, comprising the steps of:

selecting a pre-set implement angle;

sensing an engine speed sensor;

determining the duration of time which the tilt actuator has been activated; and responsively producing a position signal;

producing a command signal corresponding to said selected pre-set implement angle;

selectively activating a tilt valve in response to said command signal;

causing the tilt actuator to move an amount corresponding to said command signal.

18. The method according to claim 17, including the steps of:

adjusting said selected pre-set implement angles;

storing said adjusted implement angles in memory; and producing a command signal corresponding to said adjusted implement angle.

* * * * *